US008482465B1

(12) United States Patent
Hemmady et al.

(10) Patent No.: US 8,482,465 B1
(45) Date of Patent: Jul. 9, 2013

(54) OPTICALLY PUMPED RECONFIGURABLE ANTENNA SYSTEMS (OPRAS)

(75) Inventors: Sameer D. Hemmady, Albuquerque, NM (US); Ganesh Balakrishnan, Albuquerque, NM (US); Christos G. Christodoulou, Albuquerque, NM (US); Youssef Tawk, Albuquerque, NM (US)

(73) Assignee: STC.UNM, Albuquerque, NM (US)

( * ) Notice: Subject to any disclaimer, the term of this patent is extended or adjusted under 35 U.S.C. 154(b) by 291 days.

(21) Appl. No.: 13/004,004

(22) Filed: Jan. 10, 2011

Related U.S. Application Data

(60) Provisional application No. 61/335,695, filed on Jan. 10, 2010.

(51) Int. Cl.
*H01Q 1/36* (2006.01)

(52) U.S. Cl.
USPC ..... 343/700 MS; 343/876; 333/262

(58) Field of Classification Search
USPC ..... 343/700 MS, 853, 876; 333/105, 333/232
See application file for complete search history.

(56) References Cited

U.S. PATENT DOCUMENTS

| | | | | |
|---|---|---|---|---|
| 6,046,659 | A * | 4/2000 | Loo et al. | 333/262 |
| 6,307,519 | B1 * | 10/2001 | Livingston et al. | 343/767 |
| 6,417,807 | B1 * | 7/2002 | Hsu et al. | 343/700 MS |
| 6,469,677 | B1 * | 10/2002 | Schaffner et al. | 343/876 |
| 6,670,921 | B2 * | 12/2003 | Sievenpiper et al. | 343/700 MS |
| 7,164,387 | B2 * | 1/2007 | Sievenpiper | 343/702 |

* cited by examiner

*Primary Examiner* — Tho G Phan
(74) *Attorney, Agent, or Firm* — MH2 Technology Law Group, LLP

(57) ABSTRACT

Various embodiments provide materials and methods for an optically pumped switch device, an optically pumped reconfigurable antenna system (OPRAS), and their related antenna devices. In one embodiment, the switch devices and the antenna devices can have a photoconductive cell. The photoconductive cell can include a semiconductive substrate that is conductive to reflect a radio frequency (RF) signal in response to an optical signal.

26 Claims, 6 Drawing Sheets

300B

300A

OPTICALLY PUMPED RECONFIGURABLE ANTENNA SYSTEMS (OPRAS)

RELATED APPLICATIONS

This application claims priority to U.S. Provisional Patent Application Ser. No. 61/335,695, filed Jan. 10, 2010, which is hereby incorporated by reference in its entirety.

BACKGROUND

Antennas have become a necessary and critical component of all personal electronic devices, microwave and satellite communication systems, radar systems and military surveillance and reconnaissance platforms. In many of these systems, it is required to perform a multitude of functions across several frequency bands and operating bandwidths. In many cases, these requirements cannot be served by any single antenna but rather require the use of multiple antennas of varying form factors and geometries. This results in an increase in fabrication costs, system weight, system volume, and resources required for maintenance/repair.

Reconfigurable antennas modify their geometry and behavior to adapt to changes in environmental conditions or systems requirements, such as enhanced bandwidth, change in operating frequency, etc. For example, reconfigurable antennas can provide versatility to wireless devices due to their ability to dynamically change their operating frequency, bandwidth, aperture area, etc. while keeping their form-factor more or less constant.

RF reconfigurability of an antenna is of great interest in the field of wireless communications particularly for multiple input, multiple output (MIMO) systems and cognitive radio applications. RF reconfigurability conceptually means to dynamically alter the physical structure of the antenna by connecting and/or disconnecting different parts of the antenna structure which interact with its radiation properties and thereby alters its RF response.

SUMMARY

According to various embodiments, the present teachings include an antenna device. The antenna device can include an antenna structure including a plurality of antenna elements; a plurality of photoconductive cells, each including a semiconductive substrate, configured to selectively connect adjacent antenna elements of the plurality of antenna elements; and one or more optical sources coupled to the plurality of photoconductive cells such that an optical illumination from the one or more optical sources can be transversally coupled to the semiconductive substrate of one or more photoconductive cells selected from the plurality of photoconductive cells to alter a resonant frequency of the antenna structure.

According to various embodiments, the present teachings also include a method of configuring an antenna structure. In this method, one or more optical sources and an antenna structure including a plurality of antenna elements can first be provided. A plurality of photoconductive cells can then be configured for selectively connecting adjacent antenna elements of the plurality of antenna elements in response to an optical illumination provided by the one or more optical sources to alter a resonant frequency of the antenna structure, wherein the optical illumination is transversally coupled to a semiconductive substrate of each of one or more photoconductive cells selected from the plurality of photoconductive cells.

It is to be understood that both the foregoing general description and the following detailed description are exemplary and explanatory only and are not restrictive of the present teachings, as claimed.

BRIEF DESCRIPTION OF THE DRAWINGS

The accompanying drawings, which are incorporated in and constitute a part of this specification, illustrate several embodiments of the present teachings and together with the description, serve to explain the principles of the invention.

DESCRIPTION OF THE EMBODIMENTS

Reference will now be made in detail to exemplary embodiments of the present teachings, examples of which are illustrated in the accompanying drawings. Wherever possible, the same reference numbers will be used throughout the drawings to refer to the same or like parts. In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Various embodiments provide materials and methods for an optically pumped switch device, an optically pumped reconfigurable antenna system (OPRAS), and their related antenna devices. In one embodiment, the switch devices and the antenna devices can have a photoconductive cell. The photoconductive cell can include a semiconductive substrate that is conductive to reflect a radio frequency (RF) signal in response to an optical signal or an optical illumination.

For example, an antenna device can include one or more optical sources, an antenna structure that includes a plurality of antenna elements; and a plurality of photoconductive cells configured for selectively connecting adjacent antenna elements of the plurality of antenna elements in response to an optical illumination from the one or more optical sources. The optical illumination can be transversally coupled to a semiconductive substrate of each of one or more photoconductive cells selected from the plurality of photoconductive cells. In this case, the resonant frequency of the antenna structure can be controlled or altered by the optical illumination.

Figure 1:
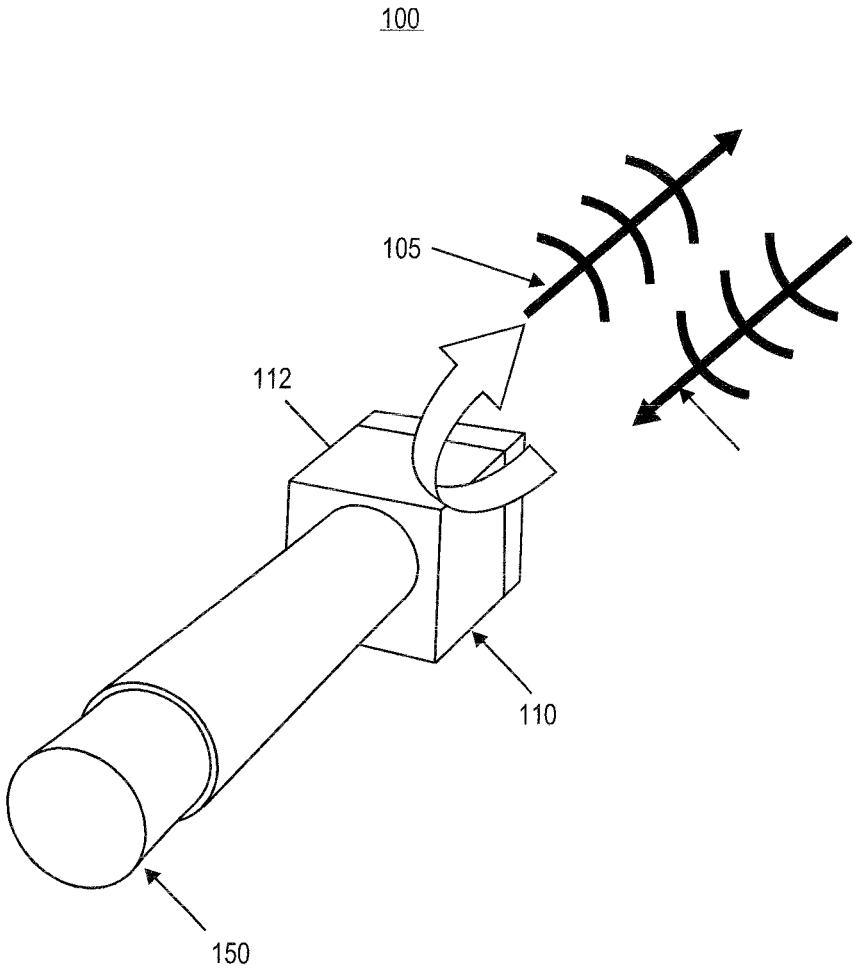
FIG. 1 depicts an exemplary switch device in accordance with various embodiments of the present teachings.

FIG. 1 depicts an exemplary switch device in accordance with various embodiments of the present teachings. As shown, the exemplary switch device 100 can include an optical source 150 and a photoconductive cell 110. The photoconductive cell 110 can be an area-element including a substrate 112. The photoconductive cell 110 can also be referred to as a "cell" or a "switching cell" or a "photoconductive switching cell."

The optical source 150 can be, for example, a laser device or a light emitting diode (LED) emitting optical signals at a wavelength of, e.g., about 2 micrometers or less, depending on specific device applications. As shown in this example, the optical source 150 can be housed to illuminate the photoconductive cell 110. In response to this illumination, the substrate 112 of the photoconductive cell 110 can be activated to be conductive, e.g., substantially metal-like, and to reflect a radio frequency (RF) signal 105, which may be transferred by an antenna element. On the other hand, when the optical source 150 is turned off, i.e., the substrate 112 or the photoconductive cell 110 is inactive, the inactive substrate 112 can be transparent to an incoming (or incident) RF signal.

The substrate 112 can be a semiconductive substrate including, e.g., Group III-V substrates such as GaAs, silicon (Si) substrates, etc. In one embodiment, the photoconductive cell 110 can be a small volume-element. The substrate 112 can be a doped substrate.

When optical signals of appropriate wavelengths fall on a semiconductive material, the energy of the photons can be transferred to the valence electrons and elevate them to the conduction band. This increase of electrons in the conduction band produces a change in the physical properties of the material in terms of its dielectric constant, loss tangent, and conductivity. The corresponding change in the dielectric constant is given by:

$$\varepsilon_r = \varepsilon_L + \frac{ne^2}{m^*\varepsilon_o\left(-w^2 + j\frac{w}{\tau}\right)},$$

where n is the concentration of electrons or holes, q is the electron charge, m* is the charge effective mass (kg), w is the operating frequency (Hz), $\tau$ is the collision time, and $\in_L$ is the dielectric constant. For example, corresponding changes in the dielectric constant of an exemplary semiconductive material silicon can be obtained by the equation above, where, $n=10^{15}$ cm$^{-3}$, $q=1.602\times10^{-19}$ C, $\tau=10^{-3}$ s, and $\in_L=11.9$ for the silicon material. Physical properties of the semiconductor material silicon under different power levels can then be derived, as summarized in Table 1 and Table 2, for w=12 GHz and w=1 GHz, respectively.

TABLE 1

| Power Level (mW) | Coductivity (S/m) | Loss Tangent | Dielectric Constant |
|---|---|---|---|
| 0 | 52 | 0.58 | 11.85 |
| 50 | 211 | 2.56 | 10.94 |
| 120 | 409 | 5.5 | 9.87 |
| 212 | 622 | 9.29 | 8.88 |

TABLE 2

| Power Level (mW) | Conductivity (S/m) | Loss Tangent | Dielectric Constant |
|---|---|---|---|
| 0 | 52 | 7.07 | 11.85 |
| 50 | 211 | 30 | 10.92 |
| 120 | 409 | 66 | 9.86 |
| 212 | 643 | 116 | 8.77 |

Tables 1-2 indicate that, as the carrier concentration increases, the conductivity of the exemplary silicon substrate increases and its dielectric constant decreases.

For an exemplary GaAs substrate in the photoconductive cell 110, the emitted photons from the optical source 150, e.g., for wavelengths in the near-IR range, such as, about 1.1 micrometers or smaller, can have energy equal to the bandcavity of the intrinsic GaAs substrate. Additionally, when the optical source 150 is operated in a pulsed mode, as opposed to continuous wave (CM, with a pulse repetition frequency in the KHz range and a pulse width greater than 50 ns, which can be several recombination time-periods in GaAs, the incident photons can excite a large number of electrons into the valence band of the exemplary GaAs substrate. As a result, the electromagnetic properties of the GaAs substrate can be altered from being purely dielectric (i.e., off-state) into substantially metallic to reflect incoming RF signals 105 (i.e., on-state).

In embodiments, the optical source 150 can have a power density of about 1 microJoule/sq. cm or higher to switch the exemplary GaAs substrate or other substrate between the off-state and the on-state. In embodiments, as also indicated by simulations, an exemplary 1 cm$^3$ GaAs substrate can be converted into a substantially metal-like substrate using milliwatt power levels, e.g., ranging from about 1 milliwatt to about 1000 milliwatts for the optical source to overcome the bandcavity of the GaAs substrate that has $E_g$=1.5 eV.

In this manner, by using modulated optical signal such as a laser beam, the switch device 100 can be operated to dynamically create conductive area-elements, which can reflect an RF signal. In embodiments, the optical source 150 can be configured inside or outside of the photoconductive cell 110.

FIGS. 2A-2E depict a portion of an exemplary optically pumped switch device at various stages of fabrication and further an exemplary OPRAS in accordance with various embodiments of the present teachings.

Figure 2A:
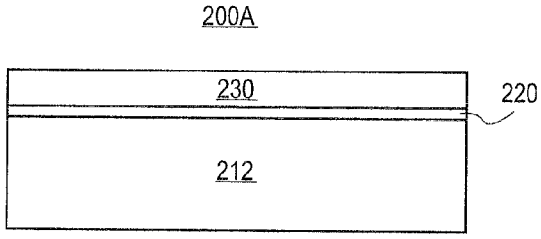
FIGS. 2A-2E depict an exemplary optically pumped reconfigurable antenna system (OPRAS) at various stages of fabrication in accordance with various embodiments of the present teachings.

In FIG. 2A, an epitaxial layer stack 200A can be formed to include an absorber layer 230 formed over an etch stop layer 220. The etch stop layer 220 can be formed over a substrate 212.

The substrate 212 can be similar or the same as the substrate 112. For example, the substrate 212 can be GaAs, Si, or any other substrates that can be optically converted from dielectric to conductive state to reflect incoming RF signals.

Figure 2D:
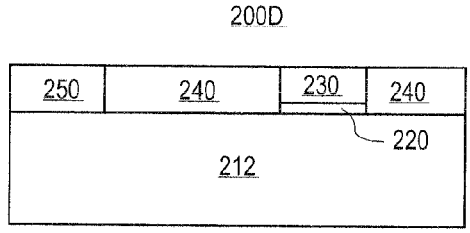

The absorber layer 230 can be an optical absorber layer for absorbing photon energy from an optical source (see 250 in FIG. 2D or 150 in FIG. 1). Various materials can be used for the absorber layer 230 including, but not limited to, InGaAs, or other suitable materials corresponding to the emitted optical signal. In an exemplary embodiment, the absorber layer 230 can be an InGaAs layer that absorbs energy at a wavelength such as about 980 nm. The InGaAs can be n-doped, for example.

The etch stop layer 220 can include any etch stop material according to the materials used for the device 200. In embodiments, the etch stop layer 220 can be optional.

Figure 2B:
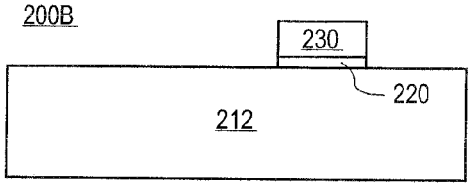

In FIG. 2B, the absorber layer 230 along with the etch stop layer 220 can be patterned over the substrate 212, exposing surface portions of the substrate 212. Various known patterning and etching techniques can be used.

Figure 2E:
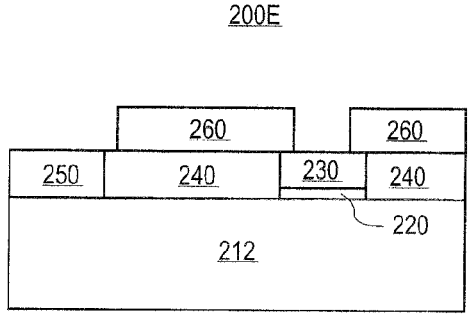
Figure 2C:
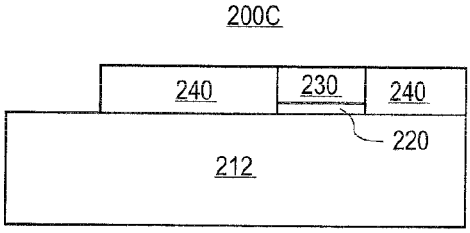

In FIG. 2C, a waveguide layer 240 can be formed and/or patterned along the exposed substrate surface, connecting to at least one end of the patterned absorber layer 230. The waveguide layer 240 can be formed of a material including $SiO_2$, etc. In an exemplary embodiment, the waveguide layer 240 can be a $SiO_2$ waveguide layer deposited on the substrate 212. In one embodiment, the waveguide layer 240 over the substrate 212 can also expose one or more surface portions of the underlying substrate 212 for the subsequent configuration of the optical source.

In FIG. 2D, an optical source 250 can be incorporated with the device 200C in FIG. 2C. For example, the optical source 250 can be configured on the exposed surfaces of substrate 212, connecting to the waveguide layer 240. The optical source 250 can be, e.g., a laser beam source, such as a laser diode that is flip chip bounded with the device 200C shown in FIG. 2C.

Alternatively, instead of being situated on the substrate 212, the optical source 250 and/or the waveguide layer 240 can be configured in a suitable manner for emitting photons to the absorber layer 230. The device 200D in FIG. 2D can form an exemplary switch device as disclosed herein.

In FIG. 2E, one or more antenna elements 260 can then be configured connecting to the absorber layer 230. In embodiments, the antenna elements 260 can be configured over the waveguide layer 240.

In operation, when the optical source 250 is turned on, optical signals (or photons) can be emitted and routed to the absorber layer 230 through the waveguide layer 240. The optical signal can then be transversally coupled to the semiconductive substrate through the optical absorber layer 230. The optical absorption or the laser absorption of the absorber layer 230 can lower its resistance, allowing electrical conduction between the antenna elements 260. In response to the transversally delivered optical signal, the semiconductive substrate can be conductive to reflect the radio frequency (RF) signal. On the other hand, when the laser device 250 is turned off with no photons emitted, the antenna elements 260 can be cut off.

As used herein, the term "transversal direction" or "transversally" refers to a coupling manner of the optical signal with the semiconductive substrate, i.e., the illumination direction of the optical signal is parallel to a surface of the semiconductive substrate, rather than in a direction normal to the substrate surface. This type of illuminating configuration allows for conformal integration and better packaging of the optically switched antenna into commercial wireless devices.

The optically pumped switch device having a photoconductive cell shown in FIG. 1 and FIGS. 2A-2E can allow for fabrication of complicated patch, fractal and reflector-type antenna systems whose radiation characteristics, including, for example, operating frequency, beam width, aperture area, etc. can be dynamically varied by controlling the optical source (e.g., the intensity), which significantly improves next-generation wireless devices such as cell phones and PDAs. For example, the disclosed antenna designs can be refined to include frequency bands corresponding to established wireless standards such as global system for mobile communications (GSM), code division multiples access (CDMA), worldwide Interoperability for Microwave Access (WiMAX), etc. Additionally, the disclosed optically pumped switch device and OPRAS can be made conformal to any surface such as the bulk-head of a ship or the fuselage of an aircraft, and the ability to dynamically change its configuration allows for the creation of stealthy antennas with low-observable radar cross-sections (RCS). Further, reconfigurable phase-array antenna systems can be incorporated with the optically pumped switch. The OPRAS can also provide simpler designs as compared with conventional reconfigurable antenna designs, which are often complicated due to cross-talk between bias lines for diode switches or microelectromechanical systems (MEMS) switches. An additional advantage is that by turning off the optical source, the photoconductive cells can quickly return to their semi-conductive, dielectric state and thereby reduce the aperture size of the antenna; thus reducing its RCS suitable for military/stealth applications.

In embodiments, the disclosed devices in FIG. 1 and FIGS. 2A-2E can be applied to substantially any antenna geometries to form various optically-pumped reconfigurable antenna systems (OPRAS) including, but not limited to, OPRAS-based fractal antennas, e.g., for UWB communication systems, OPRAS-based broadband patch antennas, e.g., for MIMO-based systems, OPRAS-based fragmented array antennas, e.g., for UWB, MIMO and 3G cellular applications, OPRAS-based phased array antennas, OPRAS-based reconfigurable corporate-feed for stealthy, conformal OPRAS-based array antennas, e.g., to be mounted on low-observable platforms, synthetic aperture radar (SAR) and inverse-SAR platforms, THz-range OPRAS-based antennas and frequency selective surfaces for improvised explosives detection technologies, biological contaminants detection, OPRAS-based switches and "on-chip" antennas for next-generation system-on-chip computer modules.

Figure 3B:
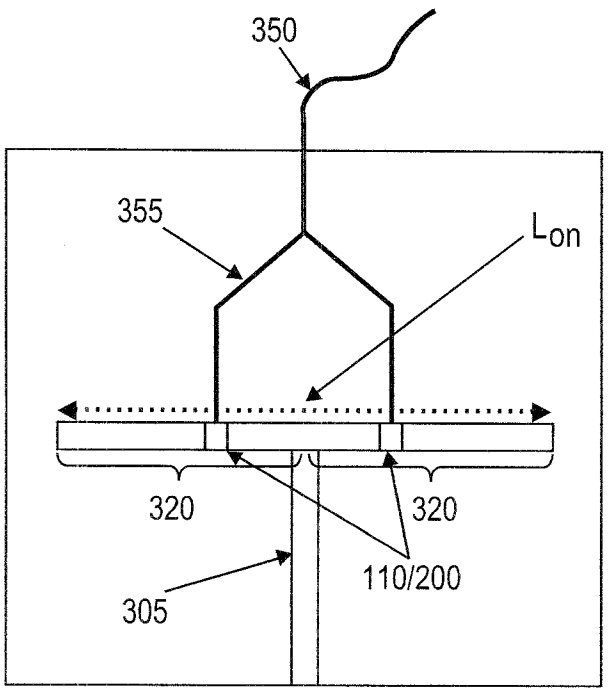
FIGS. 3A-3B depict an exemplary dipole antenna device in accordance with various embodiments of the present teachings.
Figure 3A:
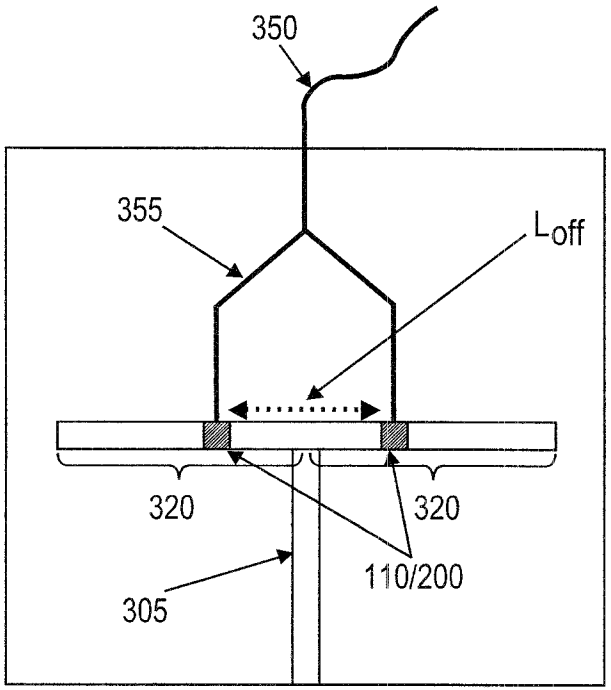
Figure 4C:
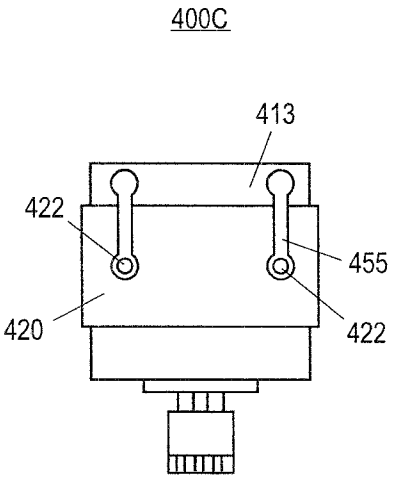
FIGS. 4A-4C depict an exemplary OPRAS-based stripline fed antenna device in accordance with various embodiments of the present teachings.
Figure 4B:
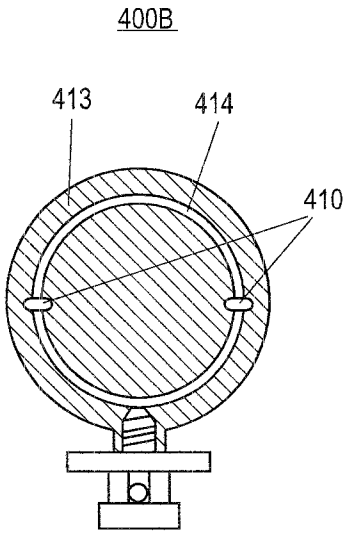
Figure 4A:
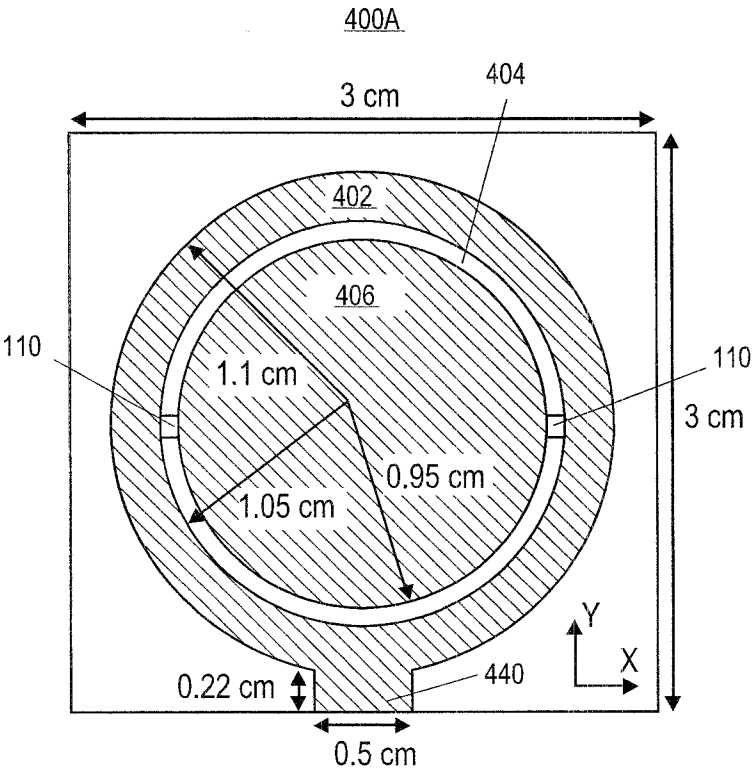

For example, FIGS. 3A-3B depict an exemplary printed dipole antenna device; FIGS. 4A-4C depict an exemplary stripline fed circular antenna device; and FIGS. 5A-5C depict an exemplary coplanar waveguide (CPW) fed antenna device in accordance with various embodiments of the present teachings.

As shown in FIGS. 3A-3B, the exemplary printed dipole antenna device can include dipole-arms 320, an optical fiber cable 350, a waveguide structure 355, a dipole 305, and photoconductive cells 110 (also see 200B or 200C in FIGS. 2B-2C).

Each dipole arm 320 can be segmented into two parts separated by a photoconductive cell 110, which can be optically pumped, e.g., through the optical fiber 350 and the waveguide structure 355. The dipole 305 can be a printed dipole formed of, e.g., a metal, as known to one of ordinary skill in the art. The dipole 305 can be connected to both dipole arms 320.

The photoconductive cells 110 can be activated by coupling an optical illumination from one or more optical sources (not illustrated in FIGS. 3A-3B) through the optical fiber cable 350 into the photonics waveguide structure 355. The photoconductive cells 110 can thus be optically switched "on" and "off" to reflect and transmit RF signals, respectively.

Generally, the resonant frequency of the dipole 305 can be as a function of the length L of the dipole-arms 320. The length L is also referred to as dipole resonant length as known. In the absence of the optical sources, i.e., when the photoconductive cell 110 is inactive, the dipole 305 can resonate at a higher frequency due to the shortened length $L_{off}$ of the dipole-arms 320, as illustrated in FIG. 3A. However, when the photoconductive cell 110 is activated by the optical illumination, the photoconductive cells 110 can be conductive and thereby extend the length of the dipole-arms 320. FIG. 3B depicts a dipole resonant length $L_{on}$ when both photoconductive cells 110 are illuminated. In embodiments, the extended dipole resonant length L can be controlled or altered by selectively illuminating one (or more) photoconductive cell selected from the plurality of photoconductive cells 110. In this specific example, the dipole resonant length L can be controlled between $L_{off}$ in FIGS. 3A and $L_{on}$ in FIG. 3B by the selective illumination on the photoconductive cells 110.

The extended dipole resonant length $L_{on}$ can result in a lower resonant frequency for the resultant dipole antenna device 300B. In this manner, the operation frequency of the dipole 305 can be altered using the optically pumped photoconductive cells and/or the OPRAS technology.

FIGS. 4A-4C depict an exemplary OPRAS-based stripline fed antenna device 400 in accordance with various embodiments of the present teachings. Specifically, FIG. 4A schematically shows a stripline fed circular antenna structure 400A, FIG. 4B shows a top view 400B of an antenna device fabricated according to the design of the structure 400A, and FIG. 4C shows a back view 400C of the fabricated antenna device.

The exemplary antenna structure 400A in FIG. 4A can include a patch substrate having an outer annular region 402 and an inner circular region 406 separated via an annular cavity 404. The outer annular region 402 can be connected to a stripline 440. The outer annular region 402 and the inner circular region 406 can be connected via two photoconductive cells 110 configured within the annular cavity 404. The patch substrate can be, e.g., Rogers RT Duroid or FR4 or other substrate used for patch antennas. For example, a Rogers RT Duroid with a dielectric constant of about 2.2 and/or a height of about 1.6 mm can be used for forming the antenna devices shown in FIGS. 4B-4C.

In one embodiment, the outer annular region 402 can have an outer diameter ranging from about 1 cm to about 10 cm such as about 2.6 cm, and an inner diameter ranging from about 1 cm to about 9 cm such as about 2.1 cm. The annular cavity 404 can have an inner diameter ranging from about 0.5 cm to about 8 cm such as about 1.9 cm, which is the diameter of the inner circular region 406. The stripline 440 can have a length ranging from about 0.1 cm to about 2 cm such as about 0.22 cm and a width ranging from about 0.1 to about 1.5 cm such as about 0.5 cm.

In FIG. 4B, the antenna device 400B are fabricated according to the antenna structure 400A in FIG. 4A having a photoconductive cell 410 configured within an annular cavity 414 of a patch substrate 413. The photoconductive cell 410 can be, e.g., silicon-based.

To couple optical signals into the exemplary silicon-based photoconductive cell 410, a hole 422 can be formed, e.g., drilled, into the substrate 413 to introduce a waveguide element such as an optical fiber cable 455, as shown in FIG. 4C. The holes 422 formed in the substrate 413 can have a diameter of, e.g., about 2 mm. The optical fiber cables 455 can be extended through the holes 422, placed underneath the substrate 413, and held via an optical fiber fixture 450, e.g., a plastic fixture. Optical signals, e.g., having a wavelength ranging from about 600 nm to about 1000 nm such as about 808 nm from an exemplary laser diode (not illustrated) can then be delivered to the silicon-based photoconductive cell 410 for switching RF signals. The silicon-based photoconductive cell 410 can have a dimension of about 1 mm×1 mm or smaller and/or a thickness of about 0.28 mm or lower.

Figure 6:
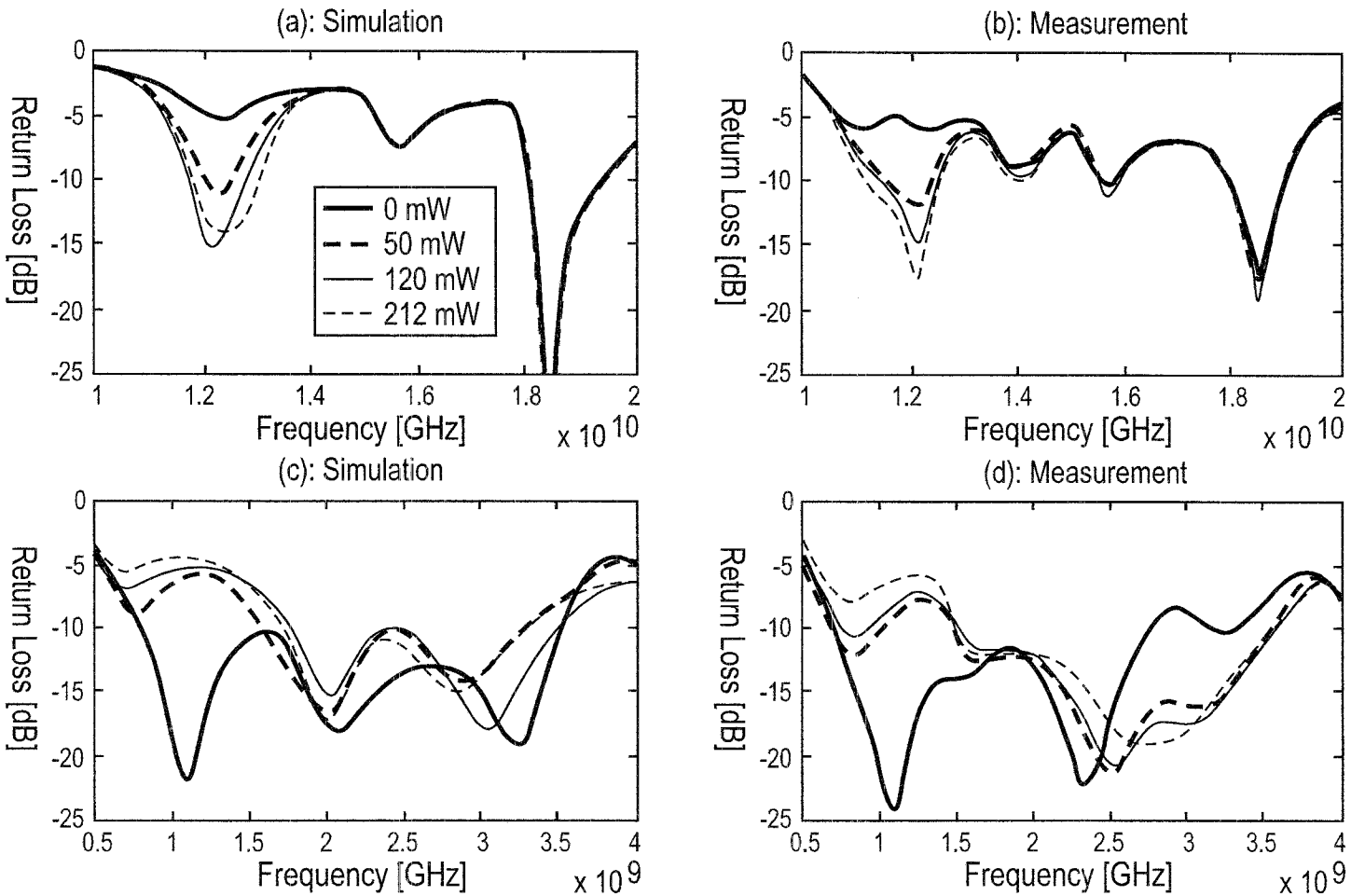
FIG. 6 depicts simulated and experimental data for the devices shown in FIGS. 4A-4C and FIG. 5 in accordance with various embodiments of the present teachings.

In operation, when two photoconductive cells 410 are off, the outer annular region 402 can be fed, which results in the antenna resonating at between about 18 GHz and about 19 GHz. Upon activation of the photoconductive cells 410, due to the mutual coupling between the outer annular region 402 and the inner circular region 406, the reconfigurability can be obtained in a frequency ranging from about 11 GHz to about 13 GHz such as about 12 GHz. This is because the combined regions 402 and 406 now represent an antenna with larger metalized surface area, thus shifting the resonant frequency lower. The simulated and the measured antenna returns loss for different power levels of the optical source to the device 400 B-C are shown in FIG. 6 [see (a/b)]. As indicated, when the pumped power (mW) increases, the RF conductivity of the photoconductive cell 410 increases thereby reducing the impedance mismatch between regions 402 and 406; and subsequently yields deeper resonances. By comparing plots between simulated data [see (a)] and the measured data [see (b)], a qualitative agreement can be observed in terms of the frequency dependence of the observed resonances.

Figure 5:
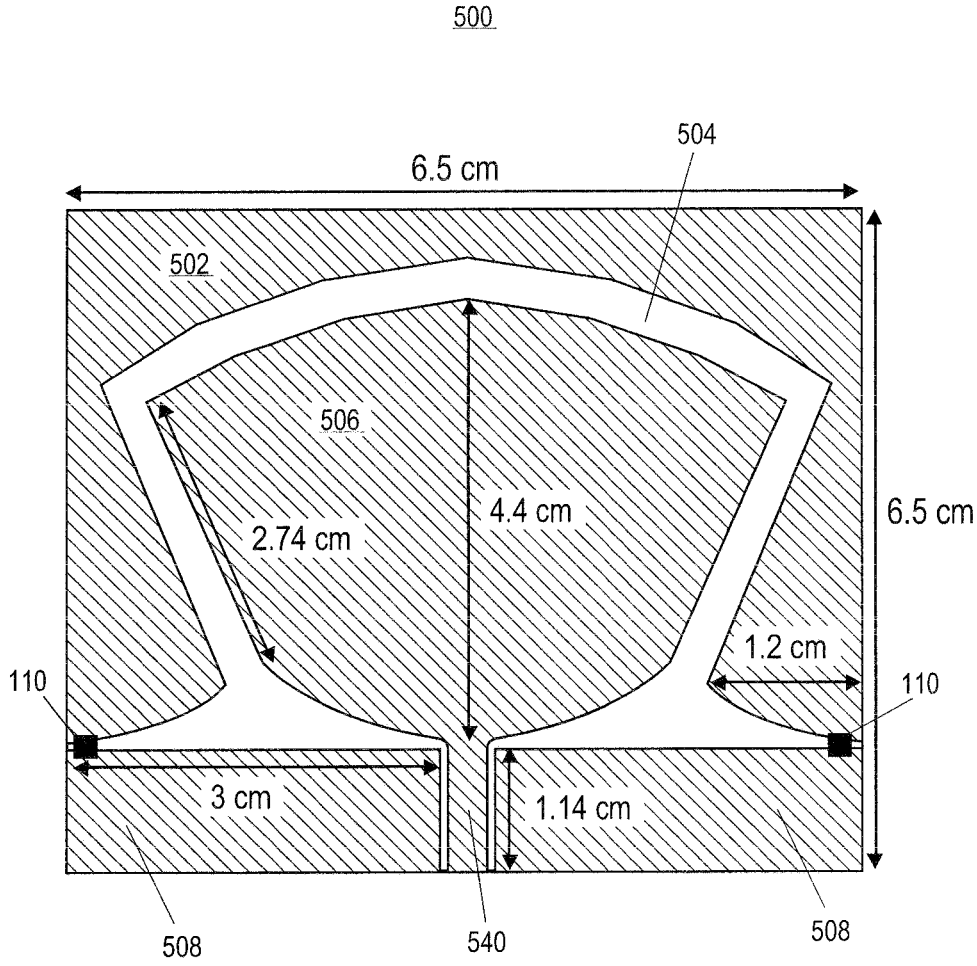
FIG. 5 depicts an exemplary OPRAS-based coplanar waveguide (CPW) fed antenna device in accordance with various embodiments of the present teachings.

FIG. 5 depicts an exemplary coplanar waveguide (CPW) fed antenna device design 500 in accordance with various embodiments of the present teachings. For example, a fabricated CPW fed antenna device can be a modified polygon shaped CPW fed patch antenna that performs a frequency tunable in the range from about 800 MHz to about 3.5 GHz. Note that although each of FIGS. 4A-4C and FIG. 5 provides exemplary dimensions as illustrated, one of ordinary skill in the art would understand that other dimensions can be used for the device 400A-C and the device 500.

The exemplary antenna device 500 can include a patch substrate having an outer region 502 and a polygonal inner region 506 separated via a cavity 504. The cavity 504 can also separate the inner region 506 along with the outer region 502 from a rectangular region 508 on each side of the feed line 540. The feed line 540 can be connected to the inner region 506. The outer region 502 and the rectangular region 508 can be connected via two photoconductive cells 110 as shown in response to an optical illumination. In embodiments, more photoconductive cells (not shown) can be included, e.g., in the cavity 504 between the outer region 502 and the polygonal inner region 506. One or more photoconductive cells can then be selected for the optical illumination, altering the resonant frequency of the antenna device to a desired value.

In embodiments, the patch substrate can be, e.g., a Getek substrate with a dielectric constant of about 3.9 and/or a height of about 1.6 mm. In certain embodiments, the rectangular region 508 on each side of the feed line 540 can have a length of about 3 cm and a width of about 1.1 cm. The polygonal inner region 506 can have a pentagon shape with a side length of about 2.7 cm and a width of about 4.4 cm.

Exemplary CPW fed antenna devices can be fabricated according to the antenna structure design in FIG. 5 having photoconductive cells 110 configured within the cavity 504 of the patch substrate. As similarly described in FIGS. 4B-4C, holes (see 422) can be formed in the patch substrate for the CPW fed antenna devices to introduce waveguide element such as optical fiber cables to the photoconductive cell. The optical fiber cables can be extended through the holes, placed underneath the patch substrate, and held via an optical fiber fixture, e.g., a plastic fixture (also see FIG. 4C). Optical signals such as about 808 nm from a laser diode can then be delivered to, e.g., a silicon-based photoconductive cell for switching RF signals. The silicon-based photoconductive cell can have a dimension of about 1 mm×1 mm or smaller and a thickness of about 0.28 mm or lower.

When the photoconductive cells 110 are inactive without using the optical source, the related antenna device can resonate from about 800 MHz to about 3.5 GHz. By switching on the photoconductive cells 110, the shape of the antenna ground changes, making the antenna cover the frequency band from 1.6 GHz to about 3.5 GHz. The simulated/measured return loss for the CPW fed antenna device for various incident laser levels are shown in FIG. 6 (see c/d). As indicated, qualitative agreement can be observed between the simulated and measured data for the exemplary CPW fed antenna device shown in FIG. 5.

Note that although two photoconductive cells 110 are illustrated in FIGS. 3A-3B, FIGS. 4A-4C, and FIG. 5, one of ordinary skill in the art would understand that a desired number of photoconductive cells can be arranged between any adjacent antenna elements of the antenna devices. One or more photoconductive cells can then be selected from the desired number of photoconductive cells for an optical illumination to selectively connect adjacent antenna elements and thus alter a resonant frequency of the disclosed antenna devices.

While the present teachings have been illustrated with respect to one or more implementations, alterations and/or modifications can be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including". "includes", "having", "has", "with", or variants thereof are used in either the detailed description and the claims, such terms are intended to be inclusive in a manner similar to the term "comprising." As used herein, the term "one or more of" with respect to a listing of items such as, for example, A and B, means A alone, B alone, or A and B. The term "at least one of" is used to mean one or more of the listed items can be selected.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume values as defined earlier plus negative values, e.g. −1, −1.2, −1.89, −2, −2.5, −3, −10, −20, −30, etc.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. An antenna device comprising:

an antenna structure comprising a plurality of antenna elements;

a plurality of photoconductive cells, each comprising a semiconductive substrate, configured to selectively connect adjacent antenna elements of the plurality of antenna elements;

one or more optical sources coupled to the plurality of photoconductive cells such that an optical illumination from the one or more optical sources is transversally coupled to the semiconductive substrate of one or more photoconductive cells selected from the plurality of photoconductive cells to alter a resonant frequency of the antenna structure;

a plurality of patch antenna elements comprising an outer annular region and an inner circular region separated by an annular cavity on a patch substrate, the plurality of photoconductive cells disposed within the annular cavity for selectively connecting the outer annular region and the inner circular region; and a waveguide element placed on a back side of the patch substrate for transversally directing the illumination into each of the selected one or more photoconductive cells.

2. The device of claim 1, wherein the optical illumination of the one or more optical source has a wavelength of about 2 micrometers or less.

3. The device of claim 1, wherein each of the one or more optical sources comprises a laser diode or a light emitting diode (LED).

4. The device of claim 1, wherein each of the one or more optical sources has a power density of about 1 microJoule/sq. cm or higher.

5. The device of claim 1, wherein the semiconductive substrate comprises GaAs, Si, or a combination thereof.

6. The device of claim 1, wherein the semiconductive substrate is doped.

7. The device of claim 1, further comprising a waveguide element and an optical absorber element disposed along a surface of the semiconductive substrate for directing the optical illumination to the semiconductive substrate.

8. The device of claim 7, wherein the optical absorber element comprises InGaAs.

9. The device of claim 7, wherein the waveguide element comprises $SiO_2$.

10. The device of claim 1, wherein the patch substrate comprises Rogers RT Duroid substrate having a dielectric constant of about 2.2.

11. The device of claim 1, wherein the outer annular region has an outer diameter ranging from about 1 cm to about 10 cm and an inner diameter ranging from about 1 cm to about 9 cm, and wherein inner circular region has a diameter ranging from about 0.5 cm to about 8 cm.

12. The device of claim 1, wherein each of the plurality of photoconductive cells has a dimension of about 1 mm×1 mm or smaller and a thickness of about 0.28 mm or lower.

13. An antenna device comprising:

an antenna structure comprising a plurality of antenna elements;

a plurality of photoconductive cells, each comprising a semiconductive substrate, configured to selectively connect adjacent antenna elements of the plurality of antenna elements; and one or more optical sources coupled to the plurality of photoconductive cells such that an optical illumination from the one or more optical sources is transversally coupled to the semiconductive substrate of one or more photoconductive cells selected from the plurality of photoconductive cells to alter a resonant frequency of the antenna structure;

wherein the antenna structure is a coplanar waveguide (CPW) fed antenna structure comprising:

a plurality of patch antenna elements disposed on a patch substrate, wherein the plurality of patch antenna elements comprise an outer region and a polygonal inner region separated by a cavity, a feed connecting to the inner region, and two rectangular regions disposed on each side of the feed line, the plurality of photoconductive cells disposed within the cavity for selectively connecting the outer region and each rectangular region, and a waveguide element placed on a back side of the patch substrate for transversally directing the optical illumination into each of the selected one or more photoconductive cells.

14. The device of claim 13, wherein the patch substrate comprises a Getek substrate having a dielectric constant of about 3.9.

15. The device of claim 13, wherein the rectangular region has a length of about 3 cm and a width of about 1.1 cm, and the polygonal inner region has a pentagon shape having a side length of about 2.7 cm and a width of about 4.4 cm.

16. The device of claim 13, wherein each the plurality of photoconductive cells has a dimension of about 1 mm×1 nm or smaller and a thickness of about 0.28 mm or lower.

17. The device of claim 13, wherein the optical illumination of the one or more optical source has a wavelength of about 2 micrometers or less.

18. The device of claim 13, wherein each of the one or more optical sources comprises a laser diode or a light emitting diode (LED).

19. The device of claim 13, wherein each of the one or more optical sources has a power density of about 1 microJoule/sq. cm or higher.

20. The device of claim 13, wherein the semiconductive substrate is doped.

21. The device of claim 13, further comprising a waveguide element and an optical absorber element disposed along a surface of the semiconductive substrate for directing the optical illumination to the semiconductive substrate.

22. A method of configuring an antenna structure comprising:

providing one or more optical sources;

providing an antenna structure comprising a plurality of antenna elements;

configuring a plurality of photoconductive cells for selectively connecting adjacent antenna elements of the plurality of antenna elements in response to an optical illumination provided by the one or more optical sources to alter a resonant frequency of the antenna structure, wherein the optical illumination is transversally coupled to a semiconductive substrate of each of one or more photoconductive cells selected from the plurality of photoconductive cells; and reconfiguring a stripline fed antenna by configuring a first antenna element comprising an outer annular region on a patch substrate and a second antenna element comprising an inner circular region separated from the outer annular region by an annular cavity on the patch substrate;

disposing the plurality of photoconductive cells within the annular cavity to selectively connect the outer annular region and the inner circular region, and placing a waveguide element on a back side of the patch substrate for transversally directing the optical illumination into each of the selected one or more photoconductive cells.

23. The method of claim 22, wherein the stripline fed antenna provides a resonant frequency altered in a range between about 11 GHz and about 13 GHz.

24. A method of configuring an antenna structure comprising:

providing one or more optical sources;

providing an antenna structure comprising a plurality of antenna elements;

configuring a plurality photoconductive cells for selectively connecting adjacent antenna elements of the plurality of antenna elements in response to an optical illumination provided by the one or more optical sources to alter a resonant frequency of the antenna structure, wherein the optical illumination is transversally coupled to a semiconductive substrate of each of one or more photoconductive cells selected from the plurality of photoconductive cells; and reconfiguring a coplanar waveguide (CPW) fed antenna by providing a plurality of patch antenna elements comprising an outer region and a polygonal inner region separated by a cavity, a feed line connecting to the inner region, and two rectangular regions disposed on each side of the feed line on a patch substrate, and disposing the plurality of photoconductive cells within the cavity for selectively connecting the outer region and each rectangular region.

25. The method of claim 24, wherein the coplanar waveguide (CPW) fed antenna provides a resonant frequency altered in a range between about 800 MHz and about 3.5 GHz.

26. An antenna device comprising:

an antenna structure comprising a plurality of antenna elements;

a plurality of photoconductive cells, each comprising a semiconductive substrate, configured to selectively connect adjacent antenna elements of the plurality of antenna elements;

one or more optical sources coupled to the plurality of photoconductive cells such that an optical illumination from the one or more optical sources is transversally coupled to the semiconductive substrate of one or more photoconductive cells selected from the plurality of photoconductive cells to alter a resonant frequency of the antenna structure;

a plurality of patch antenna elements comprising an outer region and an inner circular region separated by an cavity on a patch substrate, the plurality of photoconductive cells disposed within the cavity for selectively connecting the outer region and the inner circular region; and a waveguide element placed on a back side of the patch substrate for transversally directing the optical illumination into each of the selected one or more photoconductive cells.

* * * * *